US006792904B2

(12) United States Patent
Håkansson et al.

(10) Patent No.: US 6,792,904 B2
(45) Date of Patent: Sep. 21, 2004

(54) METHOD AND ARRANGEMENT FOR AFFECTING ENGINE BRAKING

(75) Inventors: Nils-Olof Håkansson, Stenkullen (SE); Sixten Berglund, Torslanda (SE); Göran Olsson, Göteborg (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 10/604,006

(22) Filed: Jun. 20, 2003

(65) Prior Publication Data

US 2004/0112330 A1 Jun. 17, 2004

Related U.S. Application Data

(63) Continuation of application No. PCT/SE01/02663, filed on Dec. 4, 2001, now abandoned.

(30) Foreign Application Priority Data

Dec. 22, 2000 (SE) ..... 0004870

(51) Int. Cl.[7] ..... F01L 1/34

(52) U.S. Cl. ..... 123/90.16; 123/320; 123/90.15; 123/90.39

(58) Field of Search ..... 123/90.12, 90.15–90.18, 123/90.24–90.27, 90.6, 90.39–90.47, 320–322

(56) References Cited

U.S. PATENT DOCUMENTS 5,193,497 A 3/1993 Håkansson
5,626,116 A 5/1997 Reedy et al.
5,794,589 A 8/1998 Håkansson
5,992,360 A * 11/1999 Elendt et al. ..... 123/90.16
6,000,374 A * 12/1999 Cosma et al. ..... 123/321
6,544,143 B2 4/2003 Berglund et al.

FOREIGN PATENT DOCUMENTS

SE 502154 C2 9/1995
SE 9804439-9 A0 12/1998
WO WO 0037786 A1 6/2000

* cited by examiner

*Primary Examiner*—Thomas Denion
*Assistant Examiner*—Jaime Corrigan
(74) *Attorney, Agent, or Firm*—Novak Druce LLP

(57) ABSTRACT

Method and arrangement for engine breaking in motor vehicles having an internal combustion engine with at least one cylinder, at least one exhaust valve at the cylinder and a rocker arm (4) for activation of the exhaust valve. The rocker arm (4) is arranged on a hollow rocker arm shaft (5) and arranged to be effected by ridges (2*a*, 2*b*, 2*c*) on a camshaft (2), the device additionally having a control valve (15, 16) for controlling the oil pressure in the rocker arm shaft (5), and means (6; 14) receptive to an increase of the oil pressure in the rocker arm shaft (5) being integrated in the rocker arm (4) for absorbing a play between the rocker arm (4) and the exhaust valve in the case of increase oil pressure. At least one of the ridges (2*b*, 2*c*) causes opening of the exhaust valve with an engine breaking effect. The control valve (15) includes an adjustable valve body (18, 19) and a canal (23) between the valve body (18, 19) and the rocker arm shaft (5) that has a controllable exhaust (36), the valve body (18, 19) being arranged to be positioned in a first position with pressure reducing effect and a second position without pressure reducing effect.

12 Claims, 4 Drawing Sheets

METHOD AND ARRANGEMENT FOR AFFECTING ENGINE BRAKING

CROSS REFERENCE TO RELATED APPLICATIONS

This application is a continuation patent application of International Application No. PCT/SE01/02663 filed Dec. 4, 2001 now abandoned which was published in English pursuant to Article 21(2) of the Patent Cooperation Treaty, and which claims priority to Swedish Application No. 0004870-2 filed Dec. 22, 2000. Both applications are expressly incorporated herein by reference in their entireties.

BACKGROUND OF INVENTION

1. Technical Field

The present invention relates to an arrangement for engine braking a motor vehicle that includes an internal combustion engine. Associated with the engine is at least one cylinder, at least one exhaust valve at the cylinder and a rocker arm for activation of the exhaust valve. The rocker arm is arranged on a hollow rocker arm shaft, and is further arranged to be effected by ridges on a camshaft. The device further includes a control valve for controlling oil pressure in the rocker arm shaft and means receptive to an increase of oil pressure in the rocker arm shaft that is integrated in the rocker arm for absorbing play between the rocker arm and the exhaust valve in the case of an increased oil pressure. In this case, at least one of the ridges then causes the opening of the exhaust valve with an engine braking effect. The invention also relates to a method for affecting engine braking using the above-described arrangement.

2. Background Art

Commercial vehicles such as trucks and buses are normally equipped with an engine braking function in order to spare the wheel brakes in the vehicle during braking (causing negative acceleration). In this context, it is known to provide an engine braking effect in an internal combustion engine by arranging a throttle device, for example in the form of a valve, in the exhaust system of the engine. In this way, a certain portion of the work expended during the exhaust stroke of the cylinder can be utilized to increase engine braking effects.

Another kind of engine brake is a so-called compression brake, which has the function of one or several of the engine'exhaust valves being controlled so that air which has been compressed during the compression stroke of the engine in the combustion chamber is allowed to partially flow or escape out into the exhaust system. This means that a part of the compression work carried out during the compression stroke is not utilized during the expansion stroke of the engine; feature that is also used to obtain a braking effect on the crank shaft.

In known compression brakes, the exhaust valves are controlled so that the camshaft of the engine is given a profile that is shaped with at least one extra ridge in order to obtain an opening of the exhaust valves with the intention of generating a braking effect. In addition, the valves are shaped with a small play, the size of which is chosen (together with the dimensions of the extra ridge) so that the extra ridge will not affect the valves during normal engine operation. For this purpose, the extra ridge has a lifting height that is very small compared to the ordinary exhaust ridge. In order to make the extra ridge operable during engine braking; that is so that the exhaust valves will be able to be open when engine braking, the respective rocker arm is adapted with a device in the form of a displaceable piston which is effected by oil to be positioned in an expanded position. This causes valve play to be eliminated, and the lifting height of the extra ridge then becomes sufficient in order to open the exhaust valves.

Apart from utilizing an engine braking device for braking the vehicle as such; that is, as a complement to the wheel brakes of the engine, there is also a desire to use a compression brake when shifting gears in the gearbox of the vehicle. This is apt to be an even more important aspect in commercial vehicles such as trucks and buses that are ever more frequently equipped with automatic or semi-automatic gearboxes. Such gearboxes can be likened to conventional manual gearboxes, with the difference being that the shifting of gears is carried out by means of a control device, instead of manually by the driver. FIG. 1 shows the principal phases in connection with an up-shift (i.e. to a higher gear) of such a gearbox. In that figure, a comparison between engine torque and engine speed is shown relative to time for a given type of engine.

As is evident from FIG. 1, phase "a" shows a normal operating state before a gear shift is initiated. Phase "b" shows the removal of engine torque as soon as it has been decided that an up-shift is to take place. Phase "c" shows the release of a claw coupling (clutch) in order to de-couple the gearbox from the engine. Phase "d" shows a release of the engine speed in order to match the engine speed to the newly chosen gear ratio. As soon as the engine speed has been reduced sufficiently, the new gear can be engaged. Thus, phase "e" shows the engagement of a new claw coupling. Phase "f" shows renewed application of torque, and phase "g" shows a normal operating condition after the gear shift has taken place.

In order to reduce loss of driving power of the engine during up-shift, it is an advantage if the engine speed can be matched to the new gear ratio as soon as possible. From document SE-0502154 C2 it is known to selectively introduce an exhaust brake during an up-shift when certain operating parameters are obtained, in order to achieve a rapid decrease of engine speed during the gear shifting process. In this way, it is alleged that wear on the exhaust brake system is decreased since the introduction of the exhaust brake only takes place during a small part of the total amount of the up-shift process.

An auxiliary brake system for commercial vehicles is known from U.S. Pat. No. 5,193,497 that shows an internal combustion engine equipped with a device for absorbing valve play in the valve mechanism of the engine. The absorption is carried out by means of an actively adjustable, hydraulically driven absorption means, adjustable between two positions, a contracted position, and an expanded position, which absorption means is arranged at the working end of a rocker arm whose valve play is to be absorbed. In a way that is described in detail hereinbelow, the existing pressurized oil system of the engine is used in order to guarantee the function of the device.

The auxiliary brake system that is described in the above-mentioned U.S. Pat. No. 5,193,497 has enjoyed considerable commercial success. Due to the relatively long time necessary for the absorption means to reach its extended position, however, the system according to U.S. Pat. No. 5,193,497 is not suitable for reducing engine speed at an up-shift.

From U.S. Pat. No. 6,544,143, which is expressly incorporated herein by reference, an arrangement is previously known for engine braking in an internal combustion engine. This arrangement is adapted for engine braking by the reduction of the engine speed when gear shifting, and for this purpose includes a special device that is receptive to a signal which is generated as a reply for a need to obtain a gear shift and for obtaining an absorption of a valve play in a rocker arm.

In connection with an engine brake device that is used when shifting gears, a pressure regulating valve can be utilized for supplying pressurized oil to a device for absorbing valve play in the rocker arm. Such a control valve device includes a displaceable valve body that can be affected to be positioned in a first position which corresponds to a pressure reducing function, and a second position which corresponds to a non-pressure reducing function. The oil is supplied to the rocker arm by means of a canal, which is provided with an exhaust in the shape of a very narrow hole through which oil can flow, and in this way be made to affect the valve body to, depending on operation, be positioned in any of the predetermined positions. For this purpose, the control valve is also provided with an adjustable magnet valve arranged for drainage of oil that has been fed through the narrow hole.

Although this previously known device in principle functions satisfactorily, it has some drawbacks. The main one is that it includes a small and carefully defined hole for the transport of oil, which causes a high sensitivity to clogging and tolerances. In addition, this previously known valve causes a relatively slow coupling and de-coupling, which is particularly noticeable in connection with gear shifting. In addition, the design is sensitive to external disturbances, for example in the form of temperature changes and pollution such as, for example, dirt particles or coatings.

SUMMARY OF INVENTION

A purpose of the present invention is to provide an improved device for engine braking, which in particular is suitable for utilization for a quick decrease of the speed of an engine during gear shifting.

This purpose is obtained according to the present invention through a device having a control valve that includes an adjustable valve body and a canal between the valve body and the rocker arm shaft which constitutes a controllable exhaust. The valve body is arranged to be positioned in a first position with a pressure reducing effect, and in a second position without a pressure reducing effect.

It is a further purpose of the invention to obtain a method for rapidly decreasing the speed of an engine during gear shifting.

As an example, this purpose is achieved by a method including control of a control valve having a controllable valve body and a canal between the valve body and the rocker arm shaft. A controllable exhaust is also provided with control accomplished by the positioning of the valve body in a first position with pressure reducing effect and a second position without pressure reducing effect.

By means of the invention, certain advantages are obtained. Most importantly, it can be mentioned that the invention permits a very rapid braking of an engine in connection with gear shifting. The invention also offers a very robust design with a reliable function.

Preferred embodiments of the invention will become evident by the appended dependent claims.

BRIEF DESCRIPTION OF DRAWINGS

The invention will be explained in more detail in the following, with reference to an example of a preferred embodiment and the appended figures in which.

DETAILED DESCRIPTION

Figure 1:
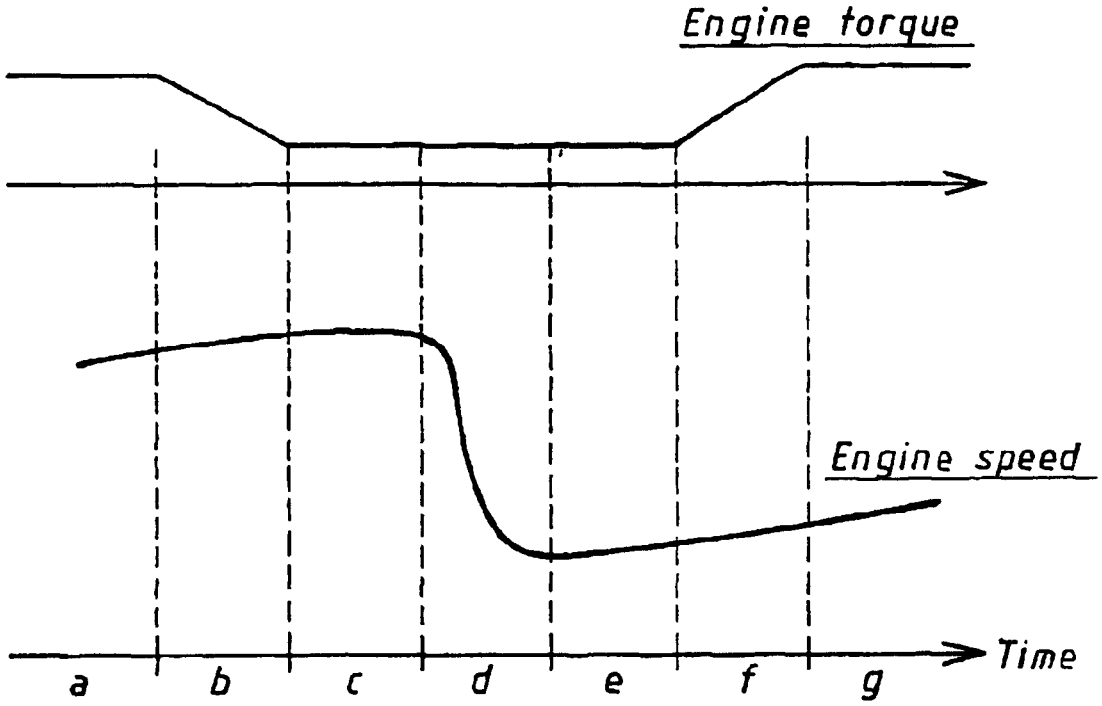
FIG. 1 is a graphical representation of the principal phases of an up-shifting in a gearbox.

As mentioned previously, FIG. 1 shows principal phases of an up-shift (i.e. to a higher gear) in the type of gearboxes that change gear while a power intermission takes place. FIG. 1 shows a comparison between engine torque and engine speed with reference to time as an up-shift takes place. Phase "a" shows a normal operating condition before a gear shift is initiated. Since phase "a" is before the up-shift, the engine speed normally increases during this phase. Phase "b" shows the removal of torque as soon as it has been decided that an up-shift is to take place. A removal of torque necessitates a matching of the rotational speed of the outgoing shaft of the engine and the ingoing shaft of the gearbox, and can be brought about in a number of ways depending on the operational conditions of the vehicle in which the gearbox is situated. Phase "c" shows the release of a claw-type coupling (clutch) in order to de-couple the gear from the engine. In this phase, the fuel supply to the engine is limited in order to prevent engine speed from increasing. Phase "d" shows the decrease of engine speed in order to match the engine speed to the higher gear ratio that is to be chosen. It is primarily the time it takes to achieve the desired engine speed that decides how quickly an up-shift can place. As soon as the engine speed has been reduced sufficiently, the new gear can be engaged. Thus, phase "e" shows the engagement of the new claw coupling. Phase "f" shows the renewed application of torque, and "g" shows a normal operating condition after the gear shift has taken place.

According to the present invention, a decrease of the engine speed during phase "d" is obtained (see FIG. 1) by utilizing a special control valve device that will be described in greater detail hereinbelow. In this way, a speedy gear shift is made possible.

Figure 2:
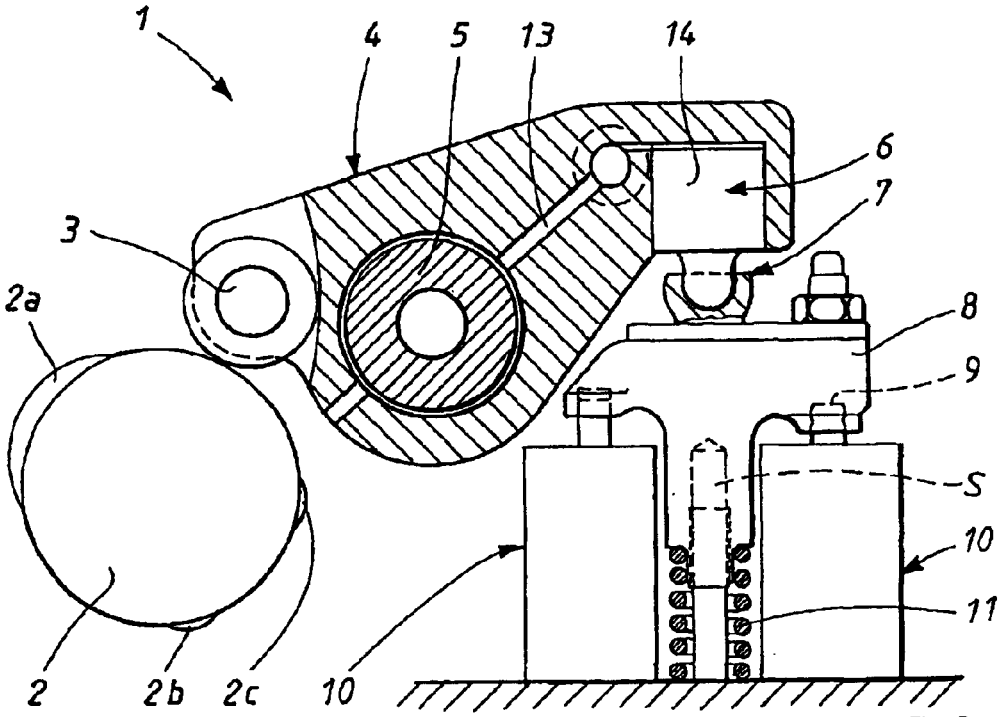
FIG. 2 is a schematic representation of an exemplary device for absorbing valve play.

The invention is in particular intended to be used in connection with gearboxes that are not synchronized. Furthermore, the invention is intended to be used in connection with a valve mechanism 1, as will become evident from FIG. 2. This valve mechanism is a modified version of the valve play absorbing mechanism shown in U.S. Pat. No. 5,193,497, the contents of which are therefore expressly incorporated herein by reference. FIG. 2 thus shows a valve mechanism 1 for an internal combustion engine. The mechanism 1 includes a camshaft 2 that, via a cylindrical roller 3, transfers a rotational movement to a rocker arm 4. The rocker arm 4 is arranged on a hollow rocker arm shaft which is intended to be arranged on a not shown cylinder head in a suitable manner, for example by means of bolts. The camshaft 2 obtains the rotational movement in a conventional way, via a transmission from the camshaft of the engine (not shown).

The movement that is transferred from the camshaft 2 to the rocker arm 4 is primarily controlled by a first ridge 2*a* which is constituted by an exhaust ridge for opening the exhaust valve at a suitable point in time. In addition, the camshaft 2 is shaped with at least one extra ridge 2*b*, 2*c*, of which a first extra ridge 2*b* is constituted by a charging ridge, which upon activation of an engine braking function, has the purpose of opening the exhaust gas valve at the end of the inlet stroke of the engine, and to keep it open in the beginning of the compression stroke. The second extra ridge 2*c* is constituted by a decompression ridge which is arranged along the camshaft 2 so that it opens the exhaust valve at the end of the compression stroke. The lifting height of the extra ridges 2*b*, 2*c* is very small relative to the lifting height of the first regular ridge 2*a*.

In principle, the camshaft can be arranged so that it rotates in either direction. The two extra ridges 2*b*, 2*c* are shaped and dimensioned according to the chosen direction of rotation.

The displacement of the rocker arm 4 is transferred via means 6 and a semi-spherically shaped control device 7 to a yoke 8, which is moveable up and down along a guiding rail (labeled S) on the cylinder head. In the embodiment shown, the yoke 8 affects two valve pipes 9. Each valve pipe is, in a conventional way, surrounded by a valve spring 10. Apart from these two valve springs 10, there is a spring 11 that is arranged below the yoke 8. The purpose of this spring is to keep the yoke in such a position that the play, which always occurs in a valve mechanism of this type, will occur between the respective valve tubes 9 and the underside of the yoke 8.

According to the invention, the above described valve mechanism is supplied with pressurized oil, which is supplied to the cavity in the rocker arm shaft 5 by means of a special control valve device, which will be described below with reference to FIGS. 3 and 4. This control valve device is arranged to deliver oil at a suitable pressure to the rocker arm shaft 5 under the influence of control from a control system, which in turn can for example, include an engine control unit and a transmission control unit. The control by means of the control system is then arranged to initiate activation of the control valve device when gear shifting takes place. At such an initiation of a gear shift, oil under pressure will be fed into the rocker arm shaft 5 and further along in a conduit 13 in the respective rocker arm 4. The oil will then influence the device, unit or means 6 arranged at the end of the rocker arm above the valve tubes 9. The means 6 is preferably in the shape of a piston that is operable in two positions, and is moveable between those positions. On of the positions or configurations is a contracted or retracted position and the other is an extended position or configuration. During normal operational conditions, oil is fed to the rocker arm shaft 5 at a pressure of about one bar. During such pressure conditions, the piston 14 is kept in its contracted position by means of the spring 11 that effects the yoke 8.

When additional braking effect is needed, the above-mentioned control system gives instructions to the control valve device to feed oil to the rocker arm shaft 5 at a higher pressure, for example two bars. In this way, a braking effect is achieved by the piston 14 assuming the extended position and at which valve play is not absorbed.

Figure 3:
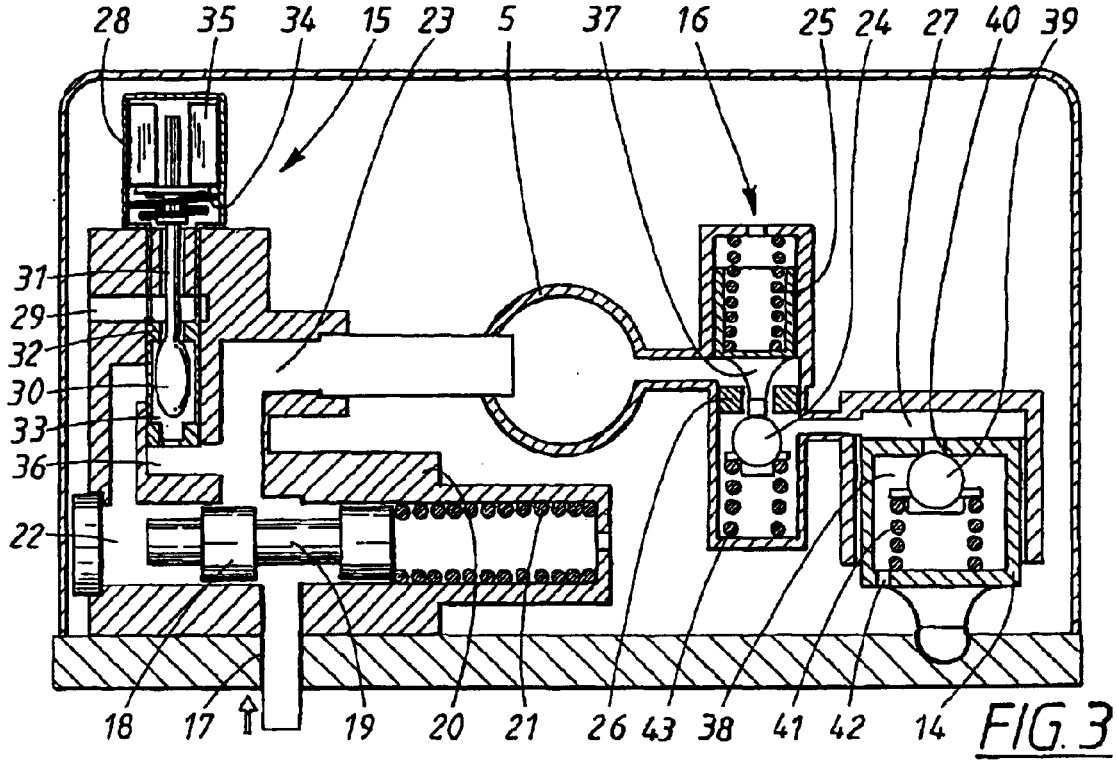
FIG. 3 is a schematic representation of the function of the present invention during normal engine operation of an internal combustion engine.

In FIG. 3, a control valve device 15 is schematically shown configured according to the present invention. This control valve device is utilized for feeding oil to the rocker arm shaft 5, which is schematically indicated in FIG. 3. The control valve device 15 interacts with a throttle valve 16 arranged in connection to the above-mentioned piston 14 in the rocker arm.

FIG. 3 shows the invention in a state which occurs during normal engine operation in an internal combustion engine; that is, when there is no gear shifting and engine braking is therefore not needed. The control valve device 15 comprises (includes) an inlet 17 for supplying pressurized oil at a certain inlet pressure $p_1$, which suitably is approximately one bar. Oil or other hydraulic fluid is then fed from an oil pump device and up to the inlet 17, in the direction indicated by an arrow in FIG. 3. Via the inlet 17, oil is brought to a pressure regulating valve with a valve body 18, which preferably is shaped as a cylinder with a narrow section 19 having a smaller diameter than the rest of the valve body 18. The valve is displaceable in a holder 20, which comprises an internal tube-shaped recess with an inner diameter which somewhat exceeds the outer diameter of the valve body 18. The oil is brought to flow towards the narrow section 19, with the valve being positioned in a position of equilibrium which is partially decided by the oil pressure flowing in at this section 19, but also by the force exerted by a coil element 21 which effects the valve body 18 in a predetermined direction (to the left in FIG. 3). In addition the valve body 18 is effected to assume this position of equilibrium by means of the pressure of oil which is present in a chamber 22, and which effects the valve body 18 in the opposite direction compared to the force from the coil element 21 and the pressure from the oil which flows in at the inlet 17.

In the above-mentioned position of equilibrium, the valve body 18 is in a position at which the portion 19, together with the holder 20, defines a relatively narrow slit through which oil is allowed to flow, but at a reduced pressure. This pressure reduced oil flow flows on through a canal 23 towards the above-mentioned throttle valve 16 which is designed with a ball 24, which is spring loaded via a second spring element 25. By means of the spring element 25, the ball 24 is normally affected in a direction away from a ball seat 26. In this way the ball 24 with its ball seat 26 defines a controllable opening for oil. In the condition shown in FIG. 3 with the oil pressure in the canal 23 being relatively low the spring element 25 manages to press the ball 24 in a direction away from the ball seat 26, by means of which a connection via the throttle valve 16 up to the piston 14 is kept open. In more detail, oil is then under relatively low pressure allowed to flow to a space 27 above the piston 14. In this condition that corresponds to normal operation of the vehicle in question, there is no absorption of the valve play; that is, there is a valve and thus no engine braking effect is obtained.

The control valve device 15, according to the teachings of the invention, furthermore includes a special solenoid valve 28 that is arranged so that it can either open or block a connection between the canal 23 and the chamber 22. The solenoid valve 28 can also open or block a connection between the chamber 23 and an outlet 29 for drainage of oil.

With reference to FIG. 2 (which does not show the control valve 15) and FIG. 3, it can be noted that a canal 23 conducts oil up to the rocker arm shaft 5. In addition, the throttle valve 16 is arranged in the rocker arm 4, which cannot be seen in FIG. 2, but which is shown in detail in FIGS. 3 and 4.

In FIG. 3 the solenoid valve 28 is shown in a condition that corresponds to normal engine operation; i.e., without any engine braking effect being obtained. The solenoid valve 28 has a valve element 30 that is shaped as the end of a displaceable valve rod 31. The valve element 30 can be positioned in two positions, so that it is in a sealing position against either an upper valve seat 32 or a lower valve seat 33.

In the position shown in FIG. 3, the valve element 30 is in an upper position as a result of influence from a spring element 34 comprised in the solenoid valve 28. In this position, the solenoid valve 28 is thus without current and the valve element 30 is in a sealing position against the upper valve seat 33. As explained above, this causes there to be a connection between the canal 23 and the chamber 22.

The solenoid valve 28 is electrically connected to, and controllable by means of, the above-mentioned control system. In more detail, the control system emits a signal for the activation of the solenoid valve 28 when gear shifting is to be initiated. This then causes the valve rod 31 to be pushed out to an extended position (and thus overcomes the force from the spring element 34) by means of an electromagnet 35 in the solenoid valve 28. In this activated position, the valve element 30 is no longer positioned against the upper valve seat 33, but is instead moved into contact with the lower valve seat 33.

Figure 4:
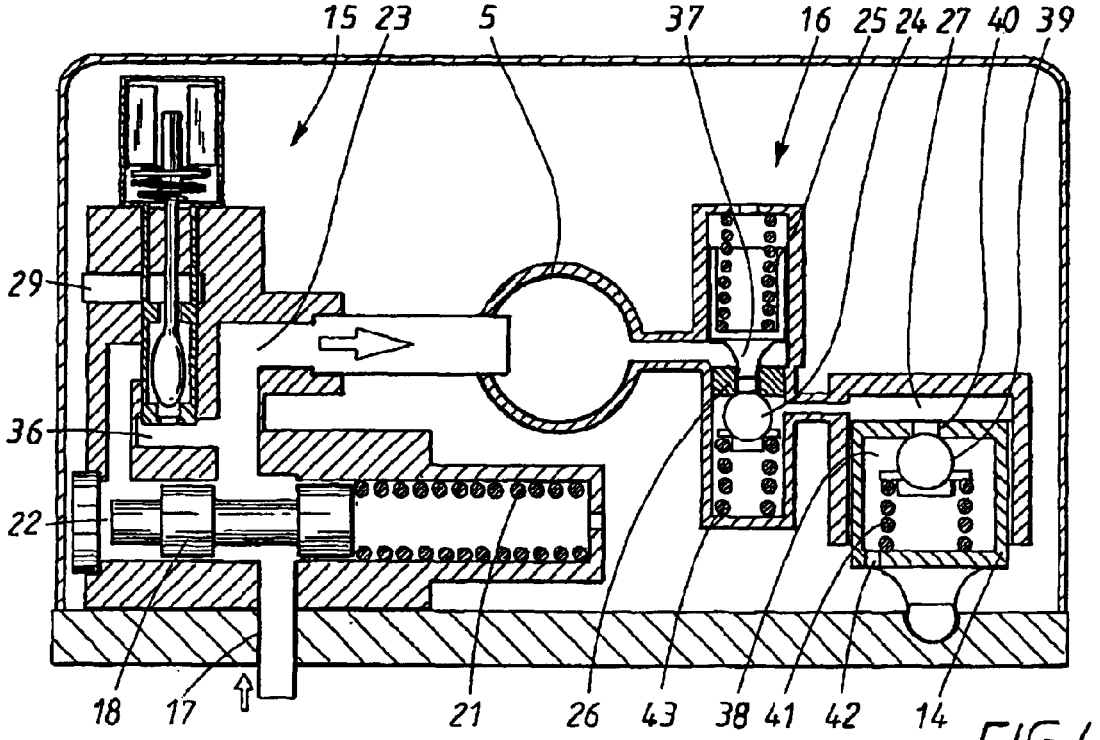
FIG. 4 is a schematic representation of the function of the present invention when braking the engine during gear shifting.

The activated state of the control valve device 15, according to the invention, is shown in FIG. 4. As is evident from FIG. 4, the connection between the valve 23 and the chamber 22 will then be closed. In this way, it can be the that the controllable outlet 36, which is defined by a connection between the canal 23 and the chamber 22, now with the aid of the solenoid valve 28, has been arranged in a position which makes the canal 23 completely sealed; i.e., without any side flow through the outlet 36. At the same time, a connection is opened between the chamber 22 and an outlet 29, so that oil which has previously been in the chamber 22 is drained. This in turn causes the valve body 18 to be slightly displaced (to the left in FIGS. 3 and 4) as a consequence of the spring force which works on the valve body 18 via the spring element 21. This causes the canal 23 to be opened completely for the supply of pressurized oil via the inlet 17 and the valve body 18.

Since the canal 23 now is completely opened, and there is no pressure reduction of the oil, flow of oil at relatively high pressure is obtained in this activated state, suitably in the order of size of two to four bars, through the canal 23 and up to the throttle valves 16. The oil pressure is then adjusted together with the other components in such a way that the oil pressure will overcome the force of the second spring element 25 and will urge the ball 24 into contact with its ball seat 26. For this purpose, the ball is connected to a piston-like element 37 against which the oil pressure works.

When the ball 24 is in contact with the ball seat 26, the oil present in the space 27 above the piston 14 will be trapped. The high pressure which is also prevalent will influence the piston 14 to assume its extended position, which means that the valve play in connection with the movement of the exhausted gas valves is essentially eliminated; i.e., the valve play is then absorbed. With reference to that which has been described above, this means that an engine braking function is now obtained.

When it is desirable to absorb valve play, for instance when further braking effect is desired in connection with gear shifting, the control system gives instructions, via signals to the solenoid valve 28, to place the valve rod 31 in its extended position. This causes a movement of the piston 14 to its extended position. In its extended position, the piston 14 uses the valve play in such a way that the rocker arm is effected both by the regular ridge 2*a* and by the extra ridges 2*b*, 2*c* which are formed on the camshaft 2. This means that the corresponding exhaust gas valves can be driven to effect engine braking.

The invention is preferably arranged in such a way that the cross-sectional sectional area which can be defined by the above-mentioned canal 23 (which for example is constituted by a drilled hole forming a tube-like groove) is in a ratio to the cross-section area which can be the to be defined by the above-mentioned controllable valve 36 in a predetermined manner. In more detail, according to the preferred embodiment the ratio between the cross-section area of the canal 23 and the cross-section area of the controllable outlet 36 is mainly within the interval 1.5. This thus means that these two cross-section areas are of essentially the same order of size. With reference to FIGS. 3 and 4, the cross-section area of the controllable outlet 36 can correspond to the area at the opening into the lower inlet of the solenoid valve 28 (i.e. mainly in connection to the lower valve seat). Due to the design of the canal and the controllable outlet, a very low fall of pressure is obtained and a very short filling time (when filling oil) at the controllable outlet as well.

For typical applications in which the valve arrangement of the present invention is utilized in connection with an internal combustion engine for a cargo vehicle, the stroke volume of a combustion cylinder is in the order of size of two liters, the diameter of the canal 23 is preferably in the order of size five to fifteen millimeters, with the diameter of the controllable outlet preferably being in the order of size of two to ten millimeters. The invention is, however, not limited to being shaped with these dimensions, but can be varied so that adjustment to various applications can be done.

According to one embodiment of the invention, the dimensions of the controllable outlet 36 are chosen in such a way that essentially no time delay is obtained during pressurization and depressurization in the controllable outlet 36 in comparison to a corresponding pressurization and depressurization in the canal 23. Thus, by means of the invention, a very rapid pressurization and depressurization is obtained that corresponds to a rapid influence on the piston 14. This in turn allows for a very rapid engine braking, and in a corresponding manner for a very rapid gear shift.

The invention allows for a particularly advantageous function in that it permits a very quick shifting between engine braking and engine operation (and vice versa) due to the large area of flow for oil in the canal 23. In addition, the solenoid valve 28 constitutes a simple and robust device that permits a simple adjustment and a reliable function.

It can thus be concluded that, according to the invention, there is provided means for controlling the oil pressure in the rocker arm shaft 5, and thus also in the space 27 in connection to the piston 14. These means includes the above described control valve device 15 and the throttle valve 16, with the control valve device 15 in turn including the controllable solenoid valve 28 by means of which the engine braking effect can be engaged and disengaged.

In addition, the piston 14 includes a valve device 38, which in turn has a ball 39 that is affected to be in contact with a ball seat 40 by means of a spring element 41. In addition, the bottom of the piston 14 is shaped with a drainage hole 42. When the pressure of the oil in the space 27 exceeds a certain value, the ball 39 will be pressed out of contact in the ball seat 40, with oil then being allowed to flow out through the drainage hole 42. In this way, a pressure limiting effect is obtained for the valve device 38.

During normal operation of the vehicle, when the control system sees that up-shifting is needed, and that application of the engine brake is needed to carry through the gear shifting, the control system instructs the solenoid valve 28 to assume the position shown in FIG. 4. To indicate that gear shifting is to take place, a number of various signals can be utilized (separately or in combination); for example, signals referring to the revolutions per minute (rpm) of the engine and its torque, the speed of the vehicle and the current positions of the pedals of the vehicle. The invention is, however, not limited to being implemented with these signals alone, but can also be used with other signals which give an indication that a gear shifting is necessary and that a braking of the engine is about to take place. As soon as the engine speed has been synchronized with the gear ratio that has been engaged, the solenoid valve 28 is instructed by the control system to reassume the initial position shown in FIG. 3. This corresponds to the solenoid valve 28 being without current. This repositioning causes the connection between the canal 23 and the chamber 22 to be established, in connection with which the valve body 18 is positioned in the above described position, at which it causes a pressure reducing effect. This in turn means that the piston 14 in the rocker arm again will exhibit a valve play that corresponds to engine braking no longer being obtained. In this way, the engine braking stops, and torque can again be applied without unnecessary delay, meaning that the power interruption will be very short.

After engine braking has been performed, the valve element 30 is restored. This means that the valve body 18 is moved back to the position that gives pressure reduction. In addition, oil is drained under high pressure from the space 27 out through the throttle valve 16. For this purpose, the above-mentioned spring element 25 is used to bring the ball 24 of the throttle valve 16 out of contact with its seat 26. Furthermore, in the throttle valve 16 there is utilized a further lower spring element 43 in order to affect the ball 24 in the direction of the seat 26. In this way, the throttle valve 16 can be positioned in the correct position depending on the level of the oil pressure.

The invention is not limited to the embodiment described above, but can be varied within the scope of the appended claims. For example, the invention can be utilized in different kinds of vehicles, for example cargo vehicles and cars. In addition, the above described braking effect can in principle be utilized both when gear shifting and in other situations when engine braking is desirable. Also, the pressurized oil which is fed from the control valve device 15 can be led up to space 27 at the rocker arm 4 in another manner than via a canal in rocker arm shaft 5, for example via special separate oil conduits.

What is claimed is:

1. Device for engine braking in motor vehicles comprising an internal combustion engine with at least one cylinder, at least one exhaust gas valve at said cylinder and a rocker arm (4) for activation of said exhaust gas valve which rocker arm (4) is arranged on a hollow rocker arm shaft (5) and arranged to be affected by ridges **(2*a*, 2*b*, 2*c*) on a camshaft (2)**, said device additionally comprising:

a control valve (15, 16) for controlling the oil pressure in said rocker arm shaft (5), and means (6; 14), receptive to an increase of oil pressure in said rocker arm shaft (5) and integrated in said rocker arm (4) for absorbing play between said rocker arm (4) and said exhaust gas valve at increased oil pressure, with at least one of said ridges **(2*b*, 2*c*) then causing opening of the exhaust gas valve with an engine braking effect, wherein said control valve (15) comprises a controllable valve body (18, 19) and a canal (23) between the valve body (18, 19) and the rocker arm shaft (5) which comprises a controllable outlet (36), with the valve body (18, 19)** being arranged to be positioned in a first position with a pressure reducing effect, and a second position without a pressure reducing effect.

2. Device according to claim 1, wherein the control valve (15, 16) is arranged for said control of oil pressure depending on a signal generated when there is a need for gear shifting of a gearbox associated with the engine, with said valve body (18, 19) being arranged to be positioned in said first and second position respectively, depending on said signal.

3. Device according to claim 1, wherein a control valve (28) is arranged in connection to said controllable outlet (36), and is arranged for opening alternatively closing of said outlet (36).

4. Device according to claim 3, wherein said control valve (28) is arranged to assume two states:

a first state where the outlet (36) is open, with the canal (23) communicating with a chamber (22), the oil content of which exerts a force against the valve body (18, 19) which corresponds to said first position of the valve body (18, 19), and a second position where the outlet (36) is closed, with said chamber (22) communicating with a drainage outlet (29) for oil, which corresponds to said second position of the valve body (18, 19).

5. Device according to claim 3 wherein said controllable valve (28) consists of an electrically controlled solenoid valve.

6. Device according to claim 3 wherein said valve body (18, 19) is arranged in a holder (20) in such a way that a pressure reducing slit is defined at said first position of the valve body (18,19).

7. Device according to claim 3 wherein the control valve device (15, 16) comprises a throttle valve (16) with valve devices (24, 25, 26) to trap an oil volume in connection to said means (6; 14) in case of increased oil pressure.

8. Device according to claim 7, wherein said valve devices (24, 25, 26) comprise a ball (24) which, with a ball seat (25), defines a controllable opening for oil, and a spring element (26) which in the case of increased oil pressure influences said ball (24) to be in contact with the ball seat (25).

9. Device according to claim 7, wherein said canal (23) exhibits a first cross-section area, and said controllable outlet (36) exhibits a second cross-section area, wherein the ratio between said first cross-section area and said second cross-section area is within the interval 1–5.

10. Device according to claim 7, wherein said canal (23) exhibits a diameter in the order of size 5–15 mm, and in that said controllable outlet (36) exhibits a diameter in the order of size of 2–10 mm.

11. Device according to claim 7 wherein the dimensions of said controllable outlet (36) are chosen so that there is essentially no time delay obtained when pressurizing and depressurizing in said controllable outlet (36) compared to the corresponding pressurization and depressurization of said canal (23).

12. Method for engine braking of motor vehicles comprising an internal combustion engine with at least one cylinder, at least one exhaust gas valve at said cylinder, and a rocker arm (4) for activation of said exhaust gas valve, which rocker arm (4) is arranged on a hollow rocker arm shaft (5) and arranged to be influenced by ridges **(2*a*, 2*b*, 2*c*) on a camshaft (2)**, with said method comprising:

controlling the oil pressure of said rocker arm shaft (5), and increasing the oil pressure in said rocker arm shaft (5) and integrated in said rocker arm (4) for absorbing play between said rocker arm (4) and said exhaust gas valve in the case of increased oil pressure, with at least one of said ridges **(2*b*, 2*c*)** being used for opening the exhaust gas valve with engine braking effect comprises:

control of a valve (15) which comprises a controllable valve body (18, 19) and a canal (22) between the valve body (18, 19) and the rocker arm shaft (5) which comprises a controllable outlet (36), with said control comprising positioning of the valve body in a first position with pressure reducing effect, and a second position without pressure reducing effect.

* * * * *